US011939866B2

(12) United States Patent
Dai et al.

(10) Patent No.: US 11,939,866 B2
(45) Date of Patent: Mar. 26, 2024

(54) PROPERTY MAPPING BY ANALOGY

(71) Applicant: Halliburton Energy Services, Inc., Houston, TX (US)

(72) Inventors: Bin Dai, Katy, TX (US); Zhonghuan Chen, Singapore (SG); Christopher Michael Jones, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/968,540

(22) Filed: Oct. 18, 2022

(65) Prior Publication Data

US 2024/0011396 A1 Jan. 11, 2024

Related U.S. Application Data

(60) Provisional application No. 63/358,724, filed on Jul. 6, 2022.

(51) Int. Cl.
*E21B 49/08* (2006.01)

(52) U.S. Cl.
CPC ..... *E21B 49/088* (2013.01); *E21B 49/0875* (2020.05)

(58) Field of Classification Search
CPC ..... E21B 49/0875; E21B 49/088
See application file for complete search history.

(56) References Cited

U.S. PATENT DOCUMENTS

| | | | | |
|---|---|---|---|---|
| 7,081,615 | B2 * | 7/2006 | Betancourt | E21B 47/10 250/255 |
| 7,822,554 | B2 * | 10/2010 | Zuo | E21B 49/08 706/14 |
| 8,271,248 | B2 * | 9/2012 | Pomerantz | E21B 49/00 703/10 |
| 8,825,408 | B2 * | 9/2014 | Freed | E21B 49/00 73/152.28 |
| 8,996,346 | B2 * | 3/2015 | Zuo | E21B 49/10 703/10 |

(Continued)

FOREIGN PATENT DOCUMENTS

| | | |
|---|---|---|
| EP | 0461321 B1 | 9/1995 |
| EP | 4012617 A1 | 6/2022 |

OTHER PUBLICATIONS

International Search Report and Written Opinion for International Application No. PCT/US2022/048977 dated Mar. 29, 2023.

*Primary Examiner* — Kenneth L Thompson
(74) *Attorney, Agent, or Firm* — John Wustenberg; C. Tumey Law Group PLLC

(57) ABSTRACT

A method and system for identifying a fluid sample. The method may comprise disposing a fluid sampling tool into a wellbore. The fluid sampling tool may comprise at least one probe configured to fluidly connect the fluid sampling tool to a formation in the wellbore and at least one passageway that passes through the at least one probe and into the fluid sampling tool. The method may further comprise drawing a wellbore fluid as a fluid sample through the at least one probe and through the at least one passageway, obtaining a fluid measurement of the fluid sample, comparing the fluid measurement to a plurality of fingerprints that populate a database, and identifying the fluid sample based at least in part on one of the plurality of fingerprints.

16 Claims, 6 Drawing Sheets

(56) References Cited

U.S. PATENT DOCUMENTS

| | | | | |
|---|---|---|---|---|
| 10,241,030 | B2 | 3/2019 | Indo et al. | |
| 10,472,960 | B2 * | 11/2019 | Lee | G06Q 50/02 |
| 10,605,797 | B2 * | 3/2020 | Zuo | G01N 33/2841 |
| 10,781,686 | B2 * | 9/2020 | Wang | E21B 49/0875 |
| 11,008,853 | B2 | 5/2021 | Jones et al. | |
| 11,021,951 | B2 | 6/2021 | Olapade et al. | |
| 11,085,294 | B2 | 8/2021 | Dai et al. | |
| 11,118,451 | B2 | 9/2021 | Dai et al. | |
| 11,280,191 | B2 * | 3/2022 | Zuo | E21B 49/02 |
| 11,306,584 | B2 * | 4/2022 | Al Dawood | E21B 49/10 |
| 11,365,627 | B2 | 6/2022 | Dai et al. | |
| 11,371,345 | B2 | 6/2022 | Olapade et al. | |
| 11,384,637 | B2 * | 7/2022 | Hsu | E21B 49/08 |
| 11,768,191 | B2 * | 9/2023 | Jalali | G01N 33/2823 702/6 |
| 2005/0133261 | A1 * | 6/2005 | Ramakrishnan | G01N 11/00 175/40 |
| 2017/0314383 | A1 | 11/2017 | Ispirescu et al. | |
| 2020/0284140 | A1 | 9/2020 | Jones et al. | |
| 2020/0370414 | A1 | 11/2020 | Schmidt et al. | |
| 2020/0378250 | A1 | 12/2020 | Olapade et al. | |
| 2020/0400017 | A1 | 12/2020 | Olapade et al. | |
| 2021/0047924 | A1 | 2/2021 | Kallehbasti et al. | |
| 2021/0054737 | A1 | 2/2021 | Dai et al. | |
| 2021/0054738 | A1 | 2/2021 | Dai et al. | |
| 2021/0071522 | A1 | 3/2021 | Dai et al. | |
| 2021/0215033 | A1 | 7/2021 | Jones et al. | |
| 2021/0231001 | A1 | 7/2021 | Jones et al. | |
| 2021/0239000 | A1 | 8/2021 | Olapade et al. | |
| 2021/0332699 | A1 | 10/2021 | Dai et al. | |
| 2021/0372281 | A1 | 12/2021 | Dai et al. | |
| 2022/0074303 | A1 * | 3/2022 | Molla | G06N 20/00 |
| 2022/0275724 | A1 | 9/2022 | Olapade et al. | |

* cited by examiner

PROPERTY MAPPING BY ANALOGY

BACKGROUND

During oil and gas exploration, information and measurements may be collected and analyzed. The information and measurements may be used to determine the quantity and quality of hydrocarbons in a reservoir and to develop or modify strategies for hydrocarbon production. For instance, the information and measurements may be used for reservoir evaluation, flow assurance, reservoir stimulation, facility enhancement, production enhancement strategies, and reserve estimation.

One technique for collecting relevant information and measurements involves obtaining and analyzing fluid samples from a reservoir of interest. There are a variety of different tools that may be used to obtain fluid samples. Fluid samples may then be analyzed to determine fluid properties, including, without limitation, component concentrations, plus fraction molecular weight, gas-oil ratios, bubble point, dew point, phase envelope, viscosity, combinations thereof, and/or the like. Conventional analysis has required transfer of the fluid samples to a laboratory for analysis. Currently, downhole analysis of the fluid sample may be performed to identify rudimentary fluid properties, which may be provided in real-time, thus, augmenting laboratory measurements and also providing information mitigating delays associated with laboratory analysis.

However, there are rock and fluid properties that may not be measured downhole and require additional laboratory testing. Thus, fluid samples may still need to be taken by a fluid sampling tool. Yet, downhole fluid sampling tools may only have room for a certain number of fluid samples during a downhole measurement operation. Determining which fluid samples to capture and take to the laboratory for further analyses is a challenging task.

BRIEF DESCRIPTION OF THE DRAWINGS

These drawings illustrate certain aspects of some examples of the present disclosure and should not be used to limit or define the disclosure.

DETAILED DESCRIPTION

Downhole sampling is a downhole operation that may be used for formation evaluation, asset decisions, and operational decisions. Fluid samples may be measured either in a laboratory environment or in a real time subsurface borehole. Downhole fluid samples need not be captured in a container for analysis. For example, optical sensor analysis may provide real-time information on fluid samples during downhole operations. Other sensors that may be used comprise resistivity sensors, capacitance sensors, acoustic sensors, chromatographic sensors, microfluidic sensors, phase behavior sensors comprising but not limited to compressibility sensors and bubble point sensors, electrochemical sensors, mass spectrometer and/or mass spectroscopy sensors. Additionally, fluid samples acquired downhole and sent to a laboratory may be specifically identified and selected based at least in part on downhole hole measurements that may be inconclusive as to a fluid sample being analyzed.

Figure 1:
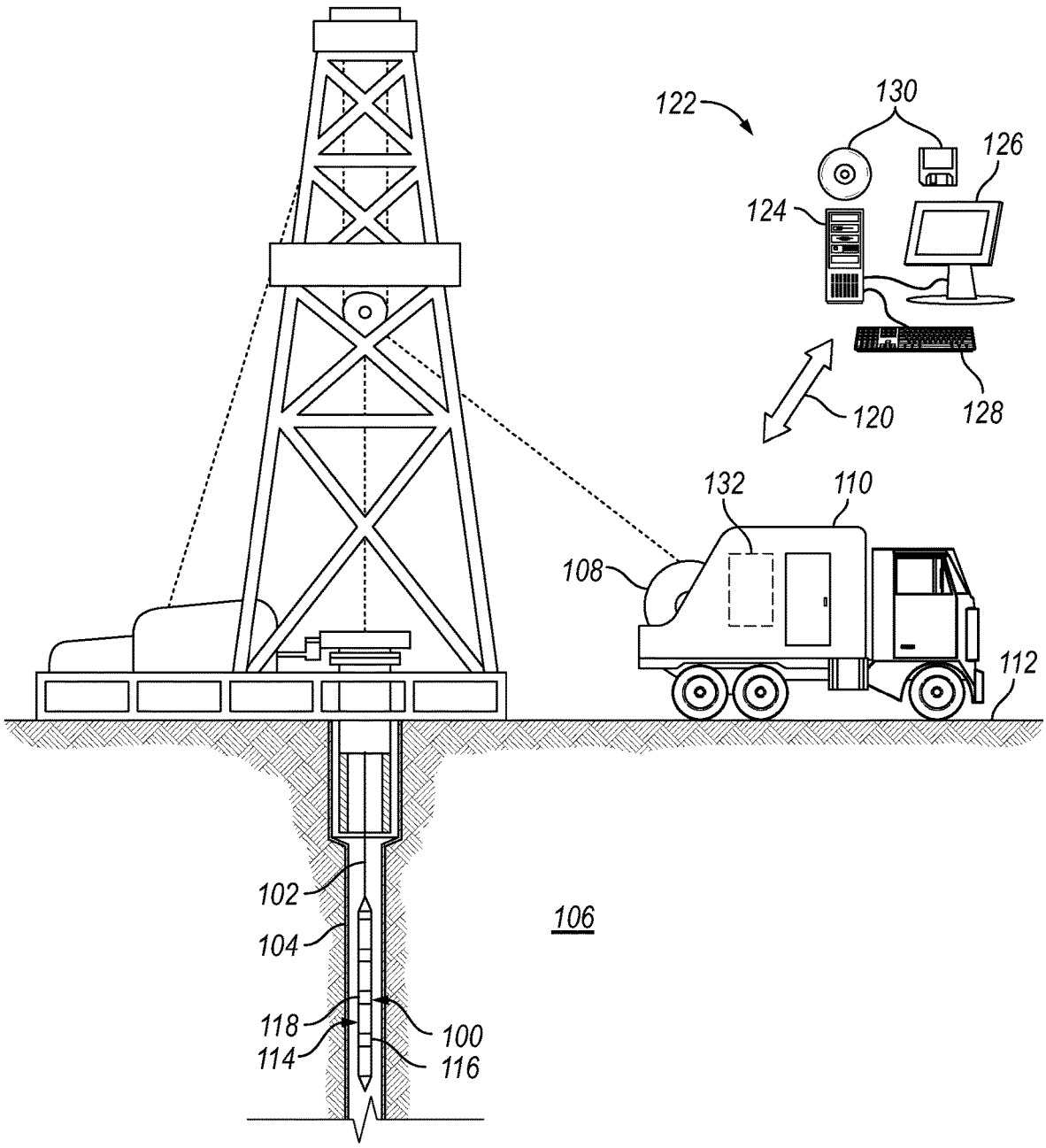
FIG. 1 is a schematic diagram of an example fluid sampling tool on a wireline.

FIG. 1 is a schematic diagram of fluid sampling tool 100 on a conveyance 102. As illustrated, wellbore 104 may extend through subterranean formation 106. In examples, reservoir fluid may be contaminated with well fluid (e.g., drilling fluid) from wellbore 104. As described herein, the fluid sample may be analyzed to determine fluid contamination and other fluid properties of the reservoir fluid. As illustrated, a wellbore 104 may extend through subterranean formation 106. While the wellbore 104 is shown extending generally vertically into the subterranean formation 106, the principles described herein are also applicable to wellbores that extend at an angle through the subterranean formation 106, such as horizontal and slanted wellbores. For example, although FIG. 1 shows a vertical or low inclination angle well, high inclination angle or horizontal placement of the well and equipment is also possible. It should further be noted that while FIG. 1 generally depicts a land-based operation, those skilled in the art will readily recognize that the principles described herein are equally applicable to subsea operations that employ floating or sea-based platforms and rigs, without departing from the scope of the disclosure.

As illustrated, a hoist 108 may be used to run fluid sampling tool 100 into wellbore 104. Hoist 108 may be disposed on a vehicle 110. Hoist 108 may be used, for example, to raise and lower conveyance 102 in wellbore 104. While hoist 108 is shown on vehicle 110, it should be understood that conveyance 102 may alternatively be disposed from a hoist 108 that is installed at surface 112 instead of being located on vehicle 110. Fluid sampling tool 100 may be suspended in wellbore 104 on conveyance 102. Other conveyance types may be used for conveying fluid sampling tool 100 into wellbore 104, including coiled tubing and wired drill pipe, conventional drill pipe for example. Fluid sampling tool 100 may comprise a tool body 114, which may be elongated as shown on FIG. 1. Tool body 114 may be any suitable material, including without limitation titanium, stainless steel, alloys, plastic, combinations thereof, and the like. Fluid sampling tool 100 may further include one or more sensors 116 for measuring properties of the fluid sample, reservoir fluid, wellbore 104, subterranean formation 106, or the like. In examples, fluid sampling tool 100 may also include a fluid analysis module 118, which may be operable to process information regarding fluid sample, as described below. Fluid sampling tool 100 may be used to collect fluid samples from subterranean formation 106 and may obtain and separately store different fluid samples from subterranean formation 106.

In examples, fluid analysis module 118 may comprise at least one a sensor that may continuously monitor a reservoir fluid. Such sensors include optical sensors, acoustic sensors, electromagnetic sensors, conductivity sensors, resistivity sensors, selective electrodes, density sensors, mass sensors, thermal sensors, chromatography sensors, viscosity sensors, bubble point sensors, fluid compressibility sensors, flow rate sensors and any combination therein. Sensors may measure a contrast between drilling fluid filtrate properties and formation fluid properties. Fluid analysis module 118 may be operable to derive properties and characterize the fluid sample. By way of example, fluid analysis module 118 may measure absorption, transmittance, or reflectance spectra and translate such measurements into component concentrations of the fluid sample, which may be lumped or de-lumped into other component concentrations, as described above. The fluid analysis module 118 may also measure gas-to-oil ratio, fluid composition, water cut, live fluid density, live fluid viscosity, formation pressure, and formation temperature. Any combination of properties measured or derived may be used as part of the sample fingerprint. Fluid analysis module 118 may also be operable to determine fluid contamination of the fluid sample and may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, fluid analysis module 118 may include random access memory (RAM), one or more processing units, such as a central processing unit (CPU), or hardware or software control logic, ROM, and/or other types of nonvolatile memory.

Any suitable technique may be used for transmitting phase signals from the fluid sampling tool 100 to the surface 112. As illustrated, a communication link 120 (which may be wired or wireless, for example) may be provided that may transmit data from fluid sampling tool 100 to an information handling system 122 at surface 112. Information handling system 122 may include a processing unit 124, a monitor 126, an input device 128 (e.g., keyboard, mouse, etc.), and/or computer media 130 (e.g., optical disks, magnetic disks) that can store code representative of the methods described herein. The information handling system 122 may act as a data acquisition system and possibly a data processing system that analyzes information from fluid sampling tool 100. For example, information handling system 122 may process the information from fluid sampling tool 100 for determination of fluid contamination. The information handling system 122 may also determine additional properties of the fluid sample (or reservoir fluid), such as component concentrations, pressure-volume-temperature properties (e.g., bubble point, phase envelop prediction, etc.) based on the fluid characterization. This processing may occur at surface 112 in real-time. Alternatively, the processing may occur downhole hole or at surface 112 or another location after recovery of fluid sampling tool 100 from wellbore 104. Alternatively, the processing may be performed by an information handling system in wellbore 104, such as fluid analysis module 118. The resultant fluid contamination and fluid properties may then be transmitted to surface 112, for example, in real-time.

Figure 2:
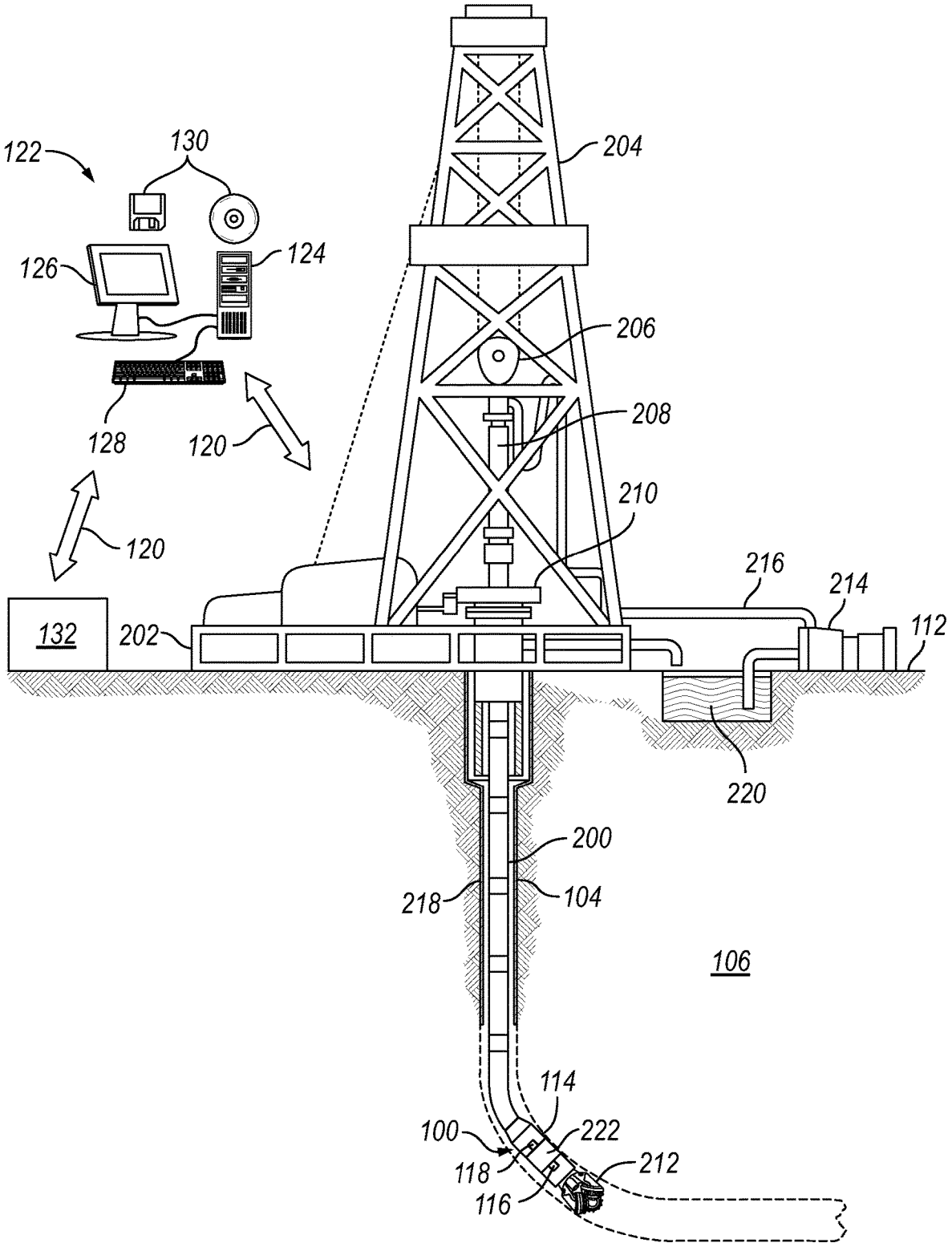
FIG. 2 is a schematic diagram of an example fluid sampling tool on a drill string.

Referring now to FIG. 2, a schematic diagram of fluid sampling tool 100 disposed on a drill string 200 in a drilling operation. Fluid sampling tool 100 may be used to obtain a fluid sample, for example, a fluid sample of a reservoir fluid from subterranean formation 106. The reservoir fluid may be contaminated with well fluid (e.g., drilling fluid) from wellbore 104. As described herein, the fluid sample may be analyzed to determine fluid contamination and other fluid properties of the reservoir fluid. As illustrated, a wellbore 104 may extend through subterranean formation 106. While the wellbore 104 is shown extending generally vertically into the subterranean formation 106, the principles described herein are also applicable to wellbores that extend at an angle through the subterranean formation 106, such as horizontal and slanted wellbores. For example, although FIG. 2 shows a vertical or low inclination angle well, high inclination angle or horizontal placement of the well and equipment is also possible. It should further be noted that while FIG. 2 generally depicts a land-based operation, those skilled in the art will readily recognize that the principles described herein are equally applicable to subsea operations that employ floating or sea-based platforms and rigs, without departing from the scope of the disclosure.

As illustrated, a drilling platform 202 may support a derrick 204 having a traveling block 206 for raising and lowering drill string 200. Drill string 200 may include, but is not limited to, drill pipe and coiled tubing, as generally known to those skilled in the art. A kelly 208 may support drill string 200 as it may be lowered through a rotary table 210. A drill bit 212 may be attached to the distal end of drill string 200 and may be driven either by a downhole motor and/or via rotation of drill string 200 from the surface 112. Without limitation, drill bit 212 may include, roller cone bits, PDC bits, natural diamond bits, any hole openers, reamers, coring bits, and the like. As drill bit 212 rotates, it may create and extend wellbore 104 that penetrates various subterranean formations 106. A pump 214 may circulate drilling fluid through a feed pipe 216 to kelly 208, downhole through interior of drill string 200, through orifices in drill bit 212, back to surface 112 via annulus 218 surrounding drill string 200, and into a retention pit 220.

Drill bit 212 may be just one piece of a downhole assembly that may include one or more drill collars 222 and fluid sampling tool 100. Fluid sampling tool 100, which may be built into the drill collars 222 may gather measurements and fluid samples as described herein. One or more of the drill collars 222 may form a tool body 114, which may be elongated as shown on FIG. 2. Tool body 114 may be any suitable material, including without limitation titanium, stainless steel, alloys, plastic, combinations thereof, and the like. Fluid sampling tool 100 may be similar in configuration and operation to fluid sampling tool 100 shown on FIG. 1 except that FIG. 2 shows fluid sampling tool 100 disposed on drill string 200. Alternatively, the sampling tool may be lowered into the wellbore after drilling operations on a wireline.

Fluid sampling tool 100 may further include one or more sensors 116 for measuring properties of the fluid sample reservoir fluid, wellbore 104, subterranean formation 106, or the like. The properties of the fluid are measured as the fluid passes from the formation through the tool and into either the wellbore or a sample container. As fluid is flushed in the near wellbore region by the mechanical pump, the fluid that passes through the tool generally reduces in drilling fluid filtrate content, and generally increases in formation fluid content. The fluid sampling tool 100 may be used to collect a fluid sample from subterranean formation 106 when the filtrate content has been determined to be sufficiently low. Sufficiently low depends on the purpose of sampling. For some laboratory testing below 10% drilling fluid contamination is sufficiently low, and for other testing below 1% drilling fluid filtrate contamination is sufficiently low. Sufficiently low also depends on the nature of the formation fluid such that lower thresholds are generally needed, the lighter the oil as designated with either a higher GOR or a higher API gravity. Sufficiently low also depends on the rate of cleanup in a cost benefit analysis since longer pumpout times to incrementally reduce the contamination levels may have prohibitively large costs. As previously described, the fluid sample may comprise a reservoir fluid, which may be contaminated with a drilling fluid or drilling fluid filtrate. Fluid sampling tool 100 may obtain and separately store different fluid samples from subterranean formation 106 with fluid analysis module 118. Fluid analysis module 118 may operate and function in the same manner as described above. However, storing of the fluid samples in the fluid sampling tool 100 may be based on the determination of the fluid contamination. For example, if the fluid contamination exceeds a tolerance, then the fluid sample may not be desired to be stored. If the fluid contamination is within a tolerance, then the fluid sample may be stored in the fluid sampling tool 100.

As previously described, information from fluid sampling tool 100 may be transmitted to an information handling system 122, which may be located at surface 112. As illustrated, communication link 120 (which may be wired or wireless, for example) may be provided that may transmit data from fluid sampling tool 100 to an information handling system 111 at surface 112. Information handling system 140 may include a processing unit 124, a monitor 126, an input device 128 (e.g., keyboard, mouse, etc.), and/or computer media 130 (e.g., optical disks, magnetic disks) that may store code representative of the methods described herein. In addition to, or in place of processing at surface 112, processing may occur downhole (e.g., fluid analysis module 118). In examples, information handling system 122 may perform computations to estimate clean fluid composition.

Figure 3:
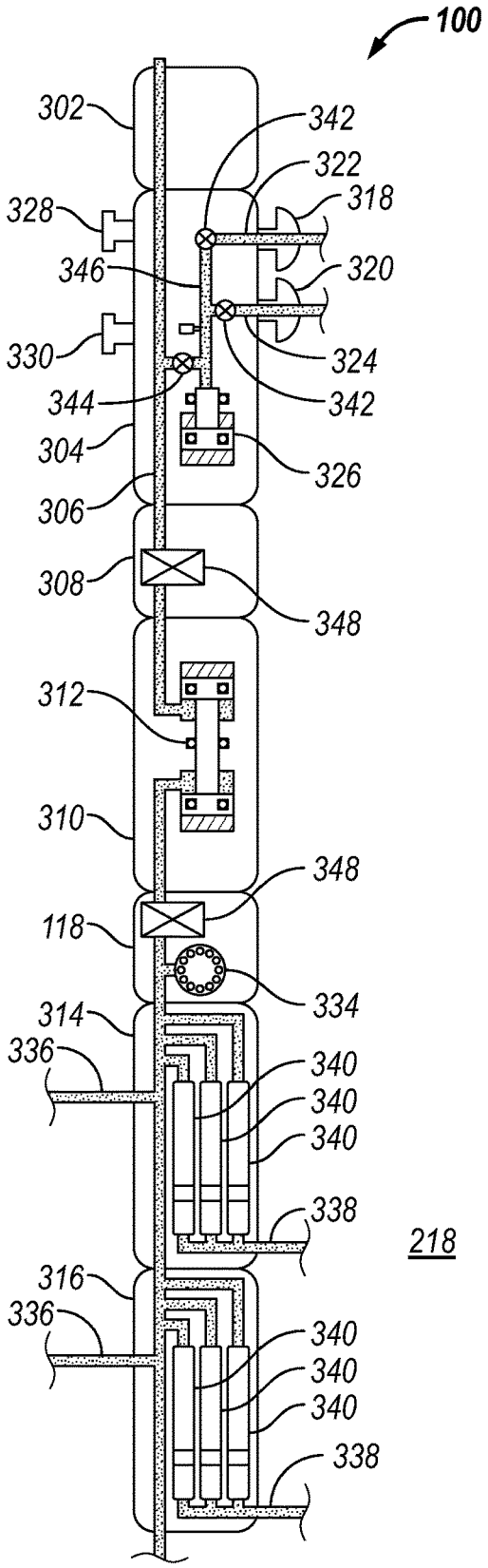
FIG. 3 is a schematic diagram of a fluid sampling tool.

FIG. 3 is a schematic of fluid sampling tool 100. In examples one embodiment, the fluid sampling tool 100 includes a power telemetry section 302 through which the tool communicates with other actuators and sensors 116 in drill string 200 or conveyance 102 (e.g., referring to FIGS. 1 and 2), the drill string's telemetry section 302, and/or directly with a surface telemetry system (not illustrated). In examples, power telemetry section 302 may also be a port through which the various actuators (e.g., valves) and sensors (e.g., temperature and pressure sensors) in the fluid sampling tool 100 may be controlled and monitored. In examples, power telemetry section 302 includes a computer that exercises the control and monitoring function. In one embodiment, the control and monitoring function is performed by a computer in another part of the drill string or wireline tool (not shown) or by information handling system 122 on surface 112 (e.g., referring to FIGS. 1 and 2).

In examples, fluid sampling tool 100 includes a dual probe section 304, which extracts fluid from the reservoir and delivers it to a passageway 306 that extends from one end of fluid sampling tool 100 to the other. Without limitation, dual probe section 304 includes two probes 318, 320 which may extend from fluid sampling tool 100 and press against the inner wall of wellbore 104 (e.g., referring to FIG. 1). Probe channels 322, 324 may connect probes 318, 320 to passageway 306. The high-volume bidirectional pump 312 may be used to pump fluids from the reservoir, through probe channels 322, 324 and to passageway 306. Alternatively, a low volume pump 326 may be used for this purpose. Two standoffs or stabilizers 328, 330 hold fluid sampling tool 100 in place as probes 318, 320 press against the wall of wellbore 104. In examples, probes 318, 320 and stabilizers 328, 330 may be retracted when fluid sampling tool 100 may be in motion and probes 318, 320 and stabilizers 328, 330 may be extended to sample the formation fluids at any suitable location in wellbore 104. Other probe sections include focused sampling probes, oval probes, or packers.

In examples, passageway 306 may be connected to other tools disposed on drill string 200 or conveyance 102 (e.g., referring to FIGS. 1 and 2). In examples, fluid sampling tool 100 may also include a quartz gauge section 308, which may include sensors to allow measurement of properties, such as temperature and pressure, of fluid in passageway 306. Additionally, fluid sampling tool 100 may include a flow-control pump-out section 310, which may include a high-volume bidirectional pump 312 for pumping fluid through passageway 306. In examples, fluid sampling tool 100 may include two multi-chamber sections 314, 316, referred to collectively as multi-chamber sections 314, 316 or individually as first multi-chamber section 314 and second multi-chamber section 316, respectively.

In examples, multi-chamber sections 314, 316 may be separated from flow-control pump-out section 310 by sensor section 332, which may house at least one non-optical fluid sensor 348 and/or at least optical measurement tool 334. It should be noted that non-optical fluid sensor 348 and optical measurement tool 334 may be disposed in any order on passageway 306. Additionally, although depicted in sensor section 332. Both non-optical fluid sensor 348 and optical measurement tool 334 may be disposed along passageway 306 at any suitable location within fluid sampling tool 100.

Non-optical fluid sensor 348 may be displaced within sensor section 332 in-line with passageway 306 to be a "flow through" sensor. In alternate examples, non-optical fluid sensor 348 may be connected to passageway 306 via an offshoot of passageway 306. Without limitation, optical measurement tool 334 may include but not limited to the density sensor, capacitance sensor, resistivity sensor, and/or combinations thereof. In examples, non-optical fluid sensor 348 may operate and/or function to measure fluid properties of drilling fluid filtrate.

Optical measurement tool 334 may be displaced within sensor section 332 in-line with passageway 306 to be a "flow through" sensor. In alternate examples, optical measurement tool 334 may be connected to passageway 306 via an offshoot of passageway 306. Without limitation, optical measurement tool 334 may include optical sensors, acoustic sensors, electromagnetic sensors, conductivity sensors, resistivity sensors, selective electrodes, density sensors, mass sensors, thermal sensors, chromatography sensors, viscosity sensors, bubble point sensors, fluid compressibility sensors, flow rate sensors, microfluidic sensors, selective electrodes such as ion selective electrodes, and/or combinations thereof. In examples, optical measurement tool 334 may operate and/or function to measure drilling fluid filtrate, discussed further below. It should be noted that often every type of sensor is not present in a particular downhole formation tester. Measurement sensors take space and power and may utilize telemetry for real time surface activities, all of which may limit the number of sensors on any given formation tester job.

Additionally, multi-chamber section 314, 316 may comprise access channel 336 and chamber access channel 338. Without limitation, access channel 336 and chamber access channel 338 may operate and function to either allow a solids-containing fluid (e.g., mud) disposed in wellbore 104 in or provide a path for removing fluid from fluid sampling tool 100 into wellbore 104. As illustrated, multi-chamber section 314, 316 may comprise a plurality of chambers 340. Chambers 340 may be sampling chamber that may be used to sample wellbore fluids, formation fluids, and/or the like during measurement operations.

During downhole measurement operations, a pumpout operation may be performed. A pumpout may be an operation where at least a portion of a fluid which may contain solids—(e.g., drilling fluid, mud, filtrate etc.) may move through fluid sampling tool 100 until substantially increasing concentrations of formation fluids enter fluid sampling tool 100. For example, during pumpout operations, probes 318, 320 may be pressed against the inner wall of wellbore 104 (e.g., referring to FIG. 1). Pressure may increase at probes 318, 320 due to compression against the formation 106 (e.g., referring to FIG. 1 or 2) exerting pressure on probes 318, 320. As pressure rises and reaches a predetermined pressure, valves 342 opens so as to close equalizer valve 344, thereby isolating fluid passageway 346 from the annulus 218. In this manner, valve 342 ensures that equalizer valve 344 closes only after probes 318, 320 has entered contact with mud cake (not illustrated) that is disposed against the inner wall of wellbore 104. In examples, as probes 318, 320 are pressed against the inner wall of wellbore 104, the pressure rises and closes the equalizer valve in fluid passageway 346, thereby isolating the fluid passageway 346 from the annulus 218. In this manner, the equalizer valve in fluid passageway 346 may close before probes 318, 320 may have entered contact with the mud cake that lines the inner wall of wellbore 104. Fluid passageway 346, now closed to annulus 218, is in fluid communication with low volume pump 326.

As low volume pump 326 is actuated, formation fluid may thus be drawn through probe channels 322, 324 and probes 318, 320. The movement of low volume pump 326 lowers the pressure in fluid passageway 346 to a pressure below the formation pressure, such that formation fluid is drawn through probe channels 322, 324 and probes 318, 320 and into fluid passageway 346. Probes 318, 320 serves as a seal to prevent annular fluids from entering fluid passageway 346. Such an operation as described may take place before, after, during or as part of a sampling operation.

Next, high-volume bidirectional pump 312 activates and equalizer valve 344 is opened. This allows for formation fluid to move toward high-volume bidirectional pump 312 through passageway 306. Other pumps may be used such as centrifugal pumps, siphon pumps, or even underbalanced actuation of natural fluid flow such as but not limited to drill stem testing operations or underbalanced drilling operations, or managed pressure operations. Formation fluid moves through passageway 306 to sensor section 332. Once the drilling fluid filtrate has moved into sensor section 332 high-volume bidirectional pump 312 may stop. This may allow the drilling fluid filtrate to be measured by optical measurement tool 334 within sensor section 332 or other suitable sensors. Without limitation, any suitable properties of the formation fluid may be measured.

These in-situ downhole measurements may allow for personnel to identify rock and fluid properties in a fluid sample that may not be easily directly measured. Physical and chemical measurements taken by various sensors within any given formation tool and/or formation sampling tool 100 (e.g., referring to FIG. 1) may collectively, in any combination, be used to identify a formation fluid "fingerprint." For this disclosure, a fingerprint is defined as a collection of sensor response patterns. The sensor response pattern is unique for a given fluid and is identified as the fluids "fingerprint." As noted above, fluid measurements may be taken by any number of devices disposed on fluid sampling tool 100. For example, quarts gauge section 308 may be utilized to measure physical properties of formation fluids such as temperature and pressure. Additionally, non-optical fluid sensor 348 may operate and/or function to measure fluid properties such as density, viscosity, and/or the like. However, in examples, formation sampling tool 100 may not comprise a bubble point sensor. Generally, bubble point is not directly observable by non-bubble point sensor and these other types of sensors may further provide a poor correlation to a bubble point measurement. By conventional regression analysis, bubble point under these circumstances may not be measured or derived. For instance, should optical measurement tool 224 (e.g., referring to FIG. 3) be the only sensor on formation sampling tool 100, then measuring or determining bubble point within a formation fluid would not be easily estimated and certainly not directly measured. Likewise, viscosity may not be easily estimated or measured if a viscosity sensor is not present in formation sampling tool 100. Furthermore, there may not be a sensor to directly measure a Joule-Thompson coefficient, a temperature and a pressure phase envelope, a differential liberation, a fluid compatibility, and/or any highly temperature dependent properties other than that close in temperature to the tool temperature. Methods and systems discussed below may estimate properties not easily measured or estimated by analogy mapping. Analogy mapping is a method of mapping a reference fluid with known properties to that of a fluid sample taken by formation sampling tool 100 by analogy of measured properties and allow estimation of unmeasured properties. Utilizing analogy mapping may allow for the identification of a downhole fluid b utilizing one or more reference fluids. Reference fluids may have known optical and physical properties, which by analogy mapping, may be used to estimate phase behavior r pressure-volume-temperature (PVT) measurement of the fluid sample taken by formation sampling tool 100.

Figure 4:
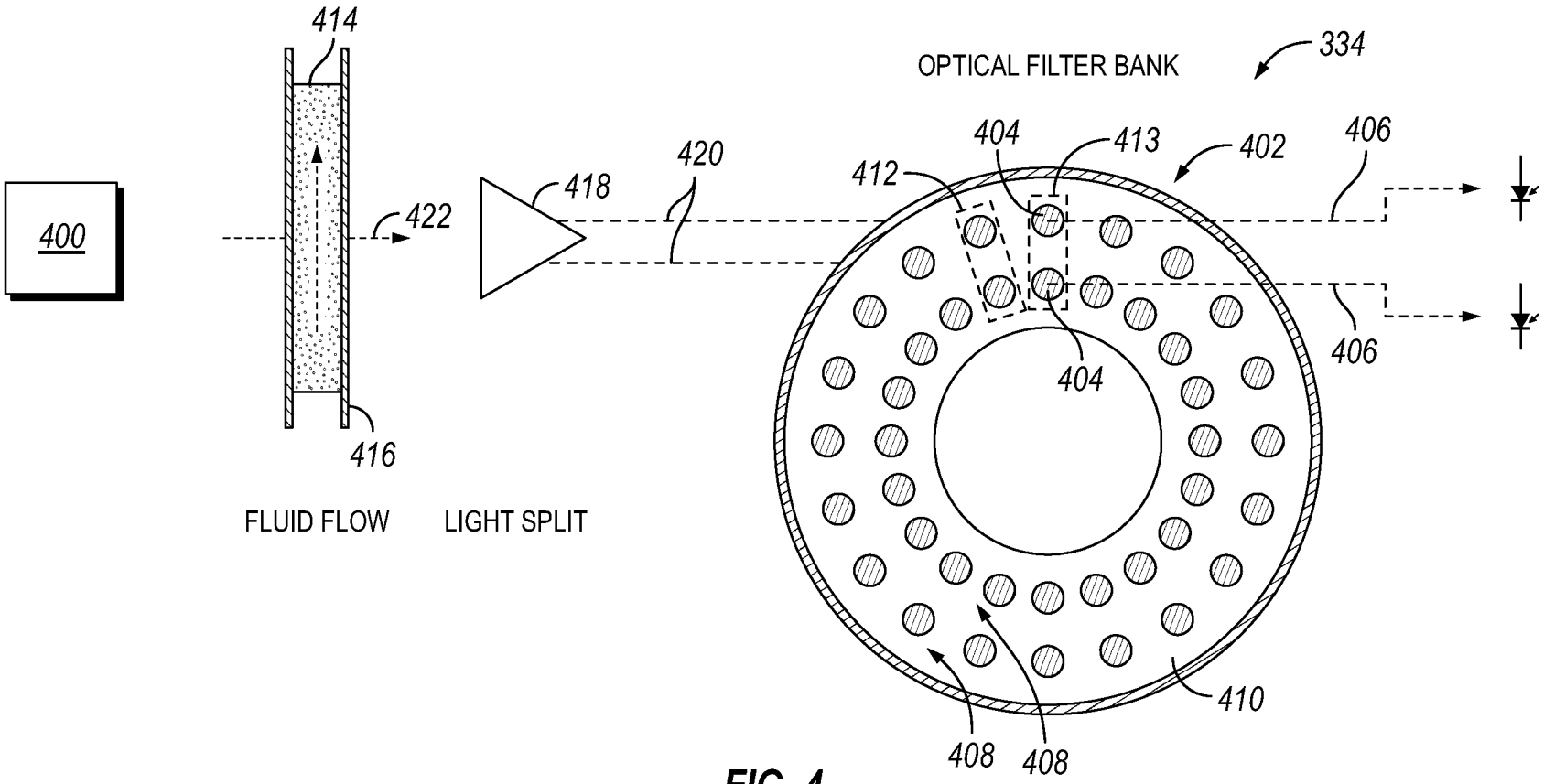
FIG. 4 depicts a hardware configuration of a dynamic subsurface optical measurement tool.

FIG. 4 depicts a hardware configuration of a dynamic subsurface optical measurement tool 334. It should be note that a channel, disclosed herein, may be a measurement of the light transmittance through an optical filter. Optical measurement tool 334 may include a light source 400, a filter bank 402 comprising a plurality of optical filters 404 (measurement of the light transmittance through an optical filter 404 is called a channel 406) configured as two rings 408 on optical plate 410, within a channel pair 412 on each azimuth. It should be noted that each channel 406 may be designed, based on the construction of each channel 406 respective optical filter 404, to measured different properties of fluid sample 414. During the rotation of optical plate 410, the two optical filters 404 on a channel pair 412 may be synchronized spatially or in time to measure substantially the same fluid sample 414 in viewing region 416, which may be a glass pipe. As discussed below, and illustrated in FIG. 4, an active channel pair 413 is a channel pair 412 in which optical measurements are being taken to form one or more channels 406. In some embodiments, channel pairs 412 may be near synchronized such that channel pairs 412 have a sufficient probability of observing the same phase, i.e., better than 10% but more desirably more than 50% and yet more desirably more than 80%. In other embodiments, more than two channels 406 may be sufficiently synchronized according to a desired probability of observing a single phase in time or space. A velocity calculation of the fluid phase specific velocities may be used to aid synchronization over longer distances, or time. Alternatively, distribution calculations, or autocorrelation calculations may be used to improve the synchronization over longer distances or time. If the channels are sufficiently close in distance or time, the channel signals may not need additional efforts of synchronization. During measurement operations, fluid samples 414 (which is formation fluid from passageway 306) may flow through a viewing region as a non-limiting example constructed by a set of windows or other transparent region of the flow path. Alternatively, the viewing region or viewing area might not be transparent to visible light but rather to the form of energy used to measure the fluid characteristics for a given sensor. As such a viewing region or area for an acoustic sensor would ideally have a low acoustic impedance even if it is not transparent to visible light. Alternatively, the viewing region or area may be transparent (i.e., pass energy with low attenuation) to infrared light, or magnetic fields instead of visible light. In some embodiments for some sensors, the viewing region 416 or area is more generally a measurement region or area as is the case with some phase behavior sensors or some density sensors. In examples, viewing region 416 may be at least a part of passageway 306 and/or a branch off of passageway 306). In one nonlimiting embodiment, light 422 absorbed by fluid sample 414 may be split into at least two ray paths 420, through a prism 418. Split light rays 420 may be measured by detectors, not shown, as they pass through channel pair 412 separately. Filter bank 402 may rotate to another channel pair 412 after the measurement of each channel 406 from channel pair 412 and may dynamically gather an optical spectra measurement of all channels after a full sampling channel rotation. It should be noted, the methods disclosed herein may not be limited in simultaneous measurements of a channel pair 412 (two optical filters 404 and their respective channel 406) but may also apply to cases with one or more optical filters 404 or filter banks 402, at least one channel 406, or, alternatively, two or more channels 406. Optical measurement tool 334 may produce and analyze the optical spectra of a fluid sample.

Figure 5:
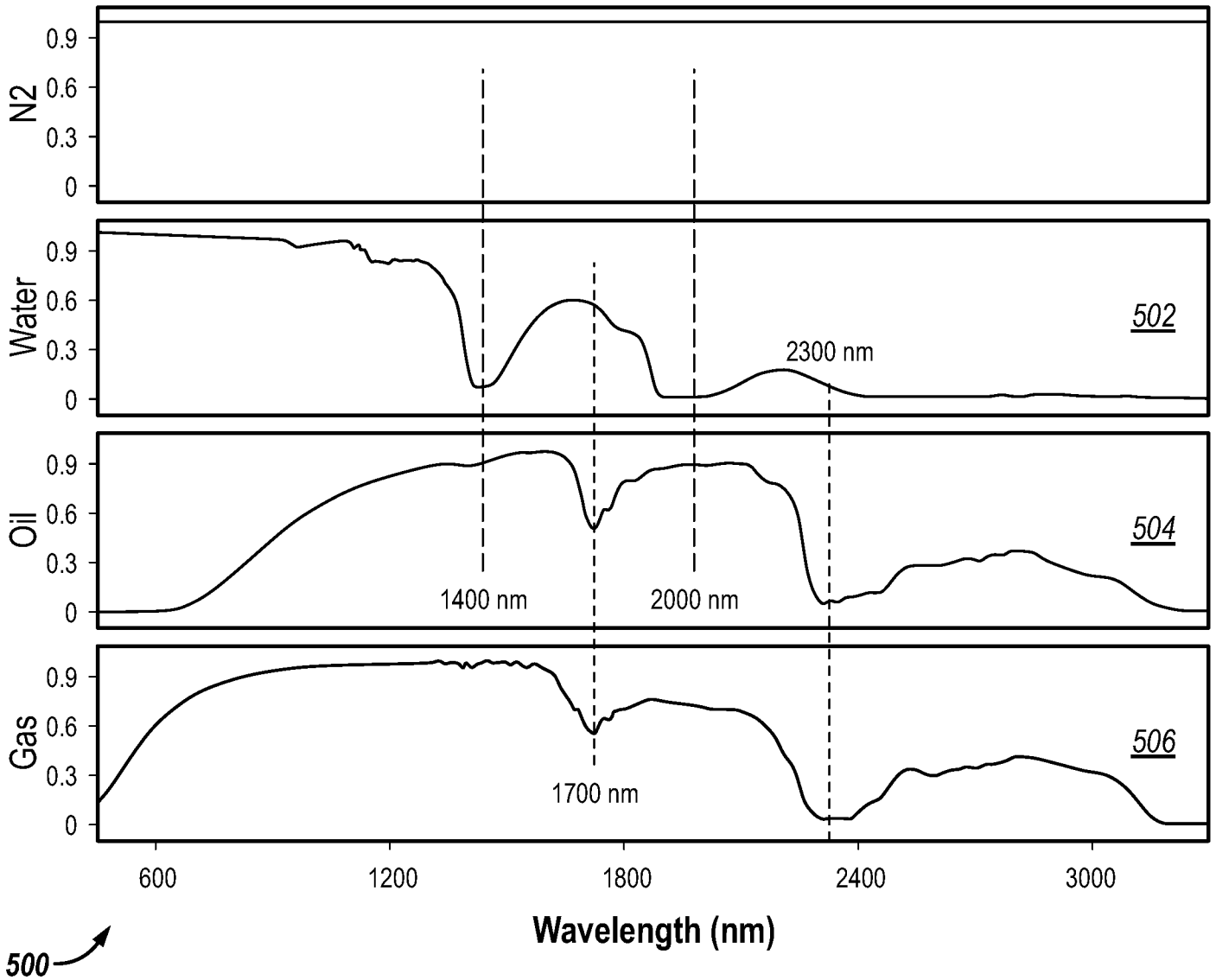
FIG. 5 depicts an optical spectra of different fluid samples.

FIG. 5 depicts optical spectra 500 from different samples. More specifically different optical absorbing characteristics of phase signals for water 502, hydrocarbons 504, and gas 506, as a function of wavelengths are depicted. Different optical spectra 500 and phase signals may be utilized to help identify a fluid sample take by formation sampling tool 100 (e.g., referring to FIG. 1). Referring to FIG. 5, water 502 has absorbing peaks at the wavelength of 1400 nm and 2000 nm, while hydrocarbons 504 have their absorbing peaks at a wavelength of 1700 nm and 2300 nm. More specifically, a phase signal of water 502 may have different amplitude responses when compared to a phase signal of hydrocarbons 504. For example, a phase signal near 1400 nm may have a weak amplitude for water 502, whereas the phase signal may have a stronger amplitude for hydrocarbons 504. It should be noted that phase signals may comprise single wavelengths or multiple wavelengths and may comprise embedded transmission functions. Conversely, in some examples phase signals may not comprise embedded transmission functions.

Figure 6:
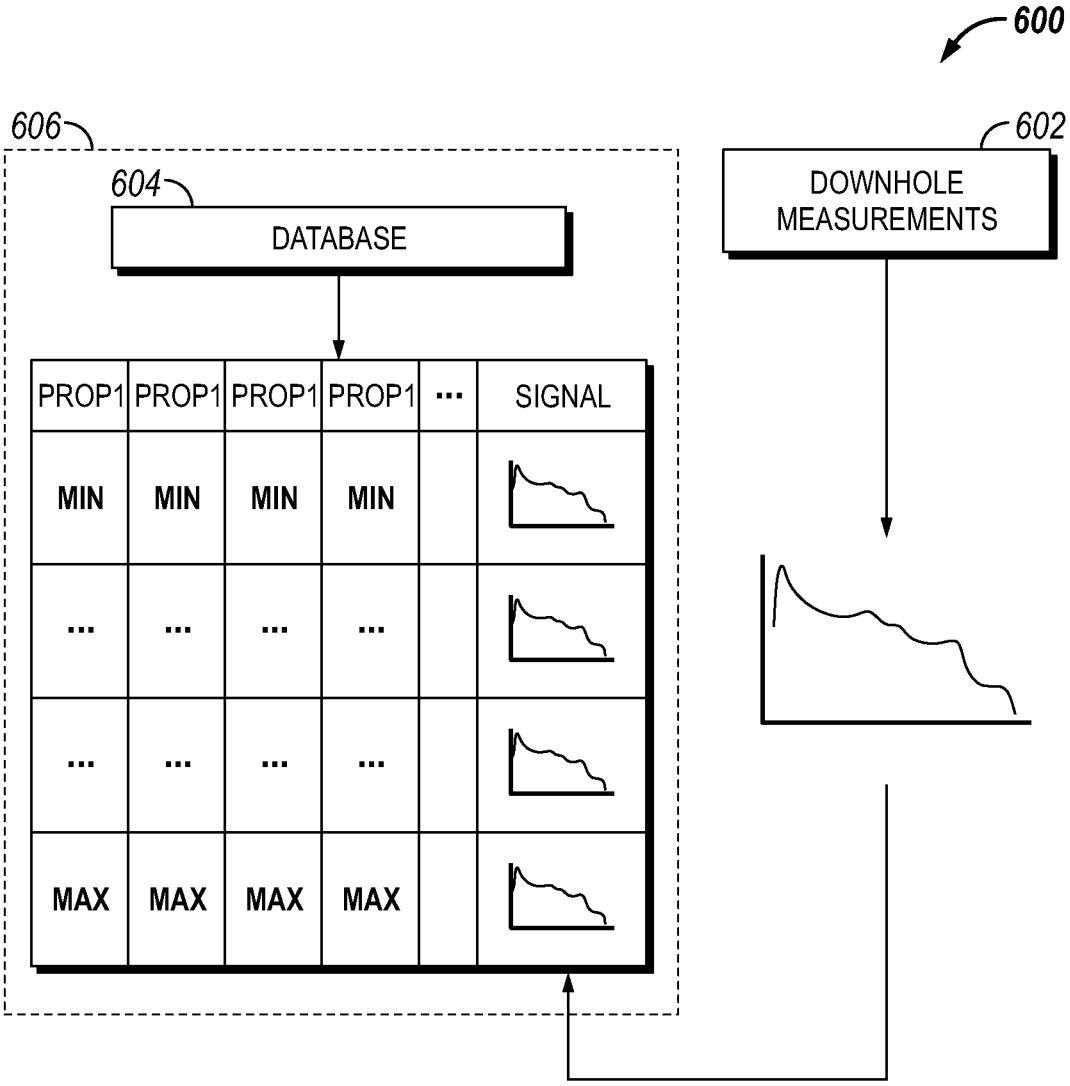
FIG. 6 depicts a workflow diagram for analogy mapping.

Phase signals illustrated in FIG. 5 may allow for the identification of a fluid samples as being a hydrocarbon 504, water 502, or gas 506 using a measured phase signal. Additionally, phase signal's optical features may be combined to form an optical fingerprint of a formation fluid. Fingerprints may be characteristic of the nature of the formation fluid comprising phase or subcategory within a phase, such as volatile oil, light oil, medium oil or heavy oil. Fingerprints may be very fine and allow differentiation of fluid types of very slight differences such as two light oils but from different source rocks. The fingerprint differences are not always ascribable to the nature of the fingerprint difference but may be used for comparison in an analogy mapping operation between fluid samples taken during measurement operation and formation fluids population in a reference database. The reference database may be utilized to FIG. 6 illustrates workflow 600 for analogy mapping in real-time or near real-time. As used herein, the term "near real-time" is defined as processing measurements at each depth before a laboratory analysis of such captured samples and real-time is while the captured samples are still at wellsite. Mapping may also take place real-time while formation sampling tool 100 (e.g., referring to FIG. 1) is disposed in wellbore 104. In examples, workflow 600 may be performed in real time downhole or uphole at a laboratory (not illustrated). Without limitation, workflow 600 may be performed and operate on information handling system 122 (e.g., referring to FIG. 1). Additionally, workflow 600 may operate on a plurality of information handling systems 122 that are connected together in a network. Workflow 600 may begin with block 602, in which measurement operations may be performed by a formation sampling tool 100, as described above. (e.g., referring to FIG. 1). Formation sampling tool 100 may measure physical properties and chemical properties of a fluid sample such as temperature, pressure, density, viscosity, and/or the like. Additionally, optical measurements may measure a phase signal of the fluid sample.

In block 604, a database populated with known fluid samples that have known physical properties, chemical properties, and/or optical properties may be assessed. Known chemical properties, physical properties, and/or optical properties are not limited to those properties acquired in a pressure-volume-temperature (PVT) test. Additionally, the known fluid samples have laboratory properties that may be found within a laboratory and are not easily or impossible to measure downhole in fluid sampling tool 100. The database may be populated from previous measurement operations, mud logging data, and/or surface measurements. In examples, mud logging data may include gas measurements, bio marker measurements, and/or other fluid measurements. The database may associate chemical properties, physical properties, and/or optical properties to a specific fluid sample to form a "fingerprint" of the specific fluid sample. The reference fluid library therein comprises the fingerprint measurements as well as the larger set of measurements to be estimated by analogy.

In block 606, an analogy mapping operation is performed. In this operation, fluid measurements from block 602 may be compared to fluid samples in block 604. During the analogy mapping operation, two or more fluid samples may be identified that may closely match the fluid measurements from block 602. For fluid samples that closely follow fluid measurements, interpolation may be utilized to identify fluid properties that may not be found from downhole measurements. This may be performed by developing a mixing model using an equation of state, which does not incorporate calculations. One nonlimiting example of finding similar samples and the degree of similarity therein is to find the closest sample in the reference database using a Euclidian distance and/or a Mahalanobis distance. The difference between the sample fluid and the fingerprints creates a quantity called the residual. A residual is defined as the difference between two sensor response patterns. The next closest sample is found that matches the residual. A second residual may then be calculated and so on until the fluid sample is sufficiently matched to one or more fingerprints in the database. The magnitude of each of the phase signal that forms fingerprints in the database is the degree to which each of the reference fluids (i.e., water, hydrocarbons, gas, etc.) contributes to the determination of the fluid sample.

For instance, the vector angle magnitude may provide an estimate, however many methods may utilize normalization to unity. As such, the magnitude sum provides one normalization method. Other normalization methods may utilize various standards appropriate to the technique, such as but not limited to the sum of squares normalization for a covariance assessment. The unknown properties are determined from the reference properties according to an appropriate mixing law as stated above. More than one combination of reference fingerprints may match the fluid sample as determined by using the methods and systems described above. Multiple matches may further be reduced with additional testing a laboratory.

Analogy mapping may be checked utilizing a confidence map. The confidence of analogy mapping may allow a sampling decision to determine if a sample from the measurement location may be allocated for further analysis in a lab at surface or prioritize already collected samples. Generally, the closer the reference fingerprints from the database are to the fluid measurements of the fluid sample, the higher confidence is bestowed upon the fluid measurements. Additionally, confidence may be gained or lost based at least in part on a mixing model. The mixing model is the rule of how two components are mixed to form a mixture. Some properties of mixture are the weighted linear combination of the property of individual component, other properties might not be. For example, the volume of two fluid components might not be linearly additive, but the weight of two components may be linearly additive. Generally, if the mixing model is linear, then confidence in the reference fingerprints being representative of the fluid measurement is increased. If the mixing model is non-linear, confidence in the reference fingerprints being representative of the fluid measurements is decreases. In combination with the property measurements, the confidence provides the necessary information to optimize prioritize surface measurement. The surface measurements may be taken at a wellsite to improve confidence in mapping or provide direct properties. The downhole measurements and/or in combination with the surface measurements potentially at the wellsite but before laboratory analysis may be used to prioritize laboratory analysis. The downhole measurements and/or in combination with the wellsite surface measurements and/or in combination with laboratory measurements may be used to make well construction, completion, and production decisions. Measurements from other tools such as downhole tools including acoustic, electromagnetic, nuclear magnetic resonance (NMR), nuclear measurements or image measurements, or surface data logging such as mud gas measurements may be used to augment the reference fingerprint so long as the appropriate transformation between reference fingerprints and fluid samples may be found. One nonlimiting example includes core sample NMR measurements as reference fluid measurements for downhole NMR. Other core measurements may be applicable for other downhole logging techniques. Other techniques such as analysis of cuttings may be appropriate as an alternative to cores. In other instances, such as but not limited to nuclear measurements, simulations based on measured reference fluid properties may provide nuclear reference measurements.

Current technologies often require a signal directly indicative of the property to perform a regression. The primary advantage of the direct signal regression method is that a small number of reference samples may be used to make the determination. The analogy mapping method requires reference fluids be sufficiently close to the sample for the property estimation to be of sufficient confidence. The analogy mapping method however may provide a very large set of estimated properties, and as such may help prioritize which samples to be measured in a laboratory, (e.g., samples with low confidence or samples of interest). The analogy mapping method may allow direct completion and production decisions should the confidence be sufficient for such decisions.

The systems and methods may include any of the various features disclosed herein, including one or more of the following statements. The systems and methods may include any of the various features disclosed herein, including one or more of the following statements.

Statement 1: A method may comprise disposing a fluid sampling tool into a wellbore. The fluid sampling tool may comprise at least one probe configured to fluidly connect the fluid sampling tool to a formation in the wellbore and at least one passageway that passes through the at least one probe and into the fluid sampling tool. The method may comprise drawing a wellbore fluid as a fluid sample through the at least one probe and through the at least one passageway, obtaining a fluid measurement of the fluid sample, comparing the fluid measurement to a plurality of fingerprints that populate a database, and identifying the fluid sample based at least in part on one of the plurality of fingerprints.

Statement 2: The method of statement 1, wherein the fluid measurement is shown as a phase signal.

Statement 3: The method of any preceding statements 1 or 2, further comprising identifying two or more fingerprints from the plurality of fingerprints that are similar to the fluid measurement.

Statement 4: The method of statement 3, further comprising forming a mixing model from the two or more fingerprints.

Statement 5: The method of statement 4, wherein if the mixing model is linear there is a higher confidence that the two or more fingerprints are representative of the fluid measurement.

Statement 6: The method of statement 4, wherein if the mixing model is non-linear there is a lower confidence that the two or more fingerprints are representative of the fluid measurement.

Statement 7: The method of statement 6, further comprising removing the fluid measurements to a laboratory for further analysis if the mixing model is non-linear.

Statement 8: The method of statement 7, further comprising applying a second fluid measurement from a second tool to further identify the fluid sample.

Statement 9: The method of statement 8, wherein the second fluid measurement is from an acoustic tool, an electromagnetic tool, or a nuclear magnetic resonance tool.

Statement 10: The method of any preceding statements 1, 2, or 3, further comprising identifying a residual from a quantity that is a difference between at least one of the plurality of fingerprints and the fluid measurement.

Statement 11: The method of any preceding statements 1, 2, 3, or 10, wherein the comparing the fluid measurement to a plurality of fingerprints is performed by a Euclidian distance or a Mahalanobis distance.

Statement 12: A system may comprise a fluid sampling tool, wherein the fluid sampling tool comprises at least one probe configured to fluidly connect the fluid sampling tool to a formation in a wellbore and at least one passageway that passes through the at least one probe and into the fluid sampling tool. The system may further comprise a sensor section, wherein the at least on passageway connects the sensor section the at least one probe and allow for a fluid sample to move from the formation to the sensor section, and wherein the sensor section takes at least one fluid measurement of the fluid sample. The system may further comprise an information handling system configured to comparing the fluid measurement to a plurality of fingerprints that populate a database and identifying the fluid sample based at least in part on one of the plurality of fingerprints.

Statement 13: The system of statement 12, wherein the fluid measurement is shown as a phase signal.

Statement 14: The system of any preceding statements 12 or 13, further comprising identifying two or more fingerprints from the plurality of fingerprints that are similar to the fluid measurement.

Statement 15: The system of statement 14, further comprising forming a mixing model from the two or more fingerprints.

Statement 16: The system of statement 15, wherein if the mixing model is linear there is a higher confidence that the two or more fingerprints are representative of the fluid measurement.

Statement 17: The system of statement 15, wherein if the mixing model is non-linear there is a lower confidence that the two or more fingerprints are representative of the fluid measurement.

Statement 18: The system of statement 17, further comprising removing the fluid measurements to a laboratory for further analysis if the mixing model is non-linear.

Statement 19: The system of statement 18, further comprising applying a second fluid measurement from a second tool to further identify the fluid sample.

Statement 20: The system of statement 19, wherein the second fluid measurement is from an acoustic tool, an electromagnetic tool, or a nuclear magnetic resonance tool.

Although the present disclosure and its advantages have been described in detail, it should be understood that various changes, substitutions and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method, comprising:

disposing a fluid sampling tool into a wellbore wherein the fluid sampling tool comprises:

at least one probe configured to fluidly connect the fluid sampling tool to a formation in the wellbore; and at least one passageway that passes through the at least one probe and into the fluid sampling tool;

drawing a wellbore fluid as a fluid sample through the at least one probe and through the at least one passageway;

obtaining a fluid measurement of the fluid sample;

comparing the fluid measurement to a plurality of fingerprints that populate a database;

identifying the fluid sample based at least in part on identifying two or more fingerprints from the plurality of fingerprints that are similar to the fluid measurement; and forming a mixing model from the two or more fingerprints.

2. The method of claim 1, wherein the fluid measurement is shown as a phase signal.

3. The method of claim 1, wherein if the mixing model is linear there is a higher confidence that the two or more fingerprints are representative of the fluid measurement.

4. The method of claim 1, wherein if the mixing model is non-linear there is a lower confidence that the two or more fingerprints are representative of the fluid measurement.

5. The method of claim 4, further comprising removing the fluid measurements to a laboratory for further analysis if the mixing model is non-linear.

6. The method of claim 5, further comprising applying a second fluid measurement from a second tool to further identify the fluid sample.

7. The method of claim 6, wherein the second fluid measurement is from an acoustic tool, an electromagnetic tool, or a nuclear magnetic resonance tool.

8. The method of claim 1, further comprising identifying a residual from a quantity that is a difference between at least one of the plurality of fingerprints and the fluid measurement.

9. The method of claim 1, wherein the comparing the fluid measurement to a plurality of fingerprints is performed by a Euclidian distance or a Mahalanobis distance.

10. A system comprising:

a fluid sampling tool, wherein the fluid sampling tool comprises:

at least one probe configured to fluidly connect the fluid sampling tool to a formation in a wellbore; and at least one passageway that passes through the at least one probe and into the fluid sampling tool; and a sensor section, wherein the at least one passageway connects the sensor section with the at least one probe and allow for a fluid sample to move from the formation to the sensor section, and wherein the sensor section takes at least one fluid measurement of the fluid sample; and an information handling system configured to:

comparing the fluid measurement to a plurality of fingerprints that populate a database;

identifying the fluid sample based at least in part on identifying two or more fingerprints from the plurality of fingerprints that are similar to the fluid measurement; and forming a mixing model from the two or more fingerprints.

11. The system of claim 10, wherein the fluid measurement is shown as a phase signal.

12. The system of claim 10, wherein if the mixing model is linear there is a higher confidence that the two or more fingerprints are representative of the fluid measurement.

13. The system of claim 10, wherein if the mixing model is non-linear there is a lower confidence that the two or more fingerprints are representative of the fluid measurement.

14. The system of claim 13, further comprising removing the fluid measurements to a laboratory for further analysis if the mixing model is non-linear.

15. The system of claim 14, further comprising applying a second fluid measurement from a second tool to further identify the fluid sample.

16. The system of claim 15, wherein the second fluid measurement is from an acoustic tool, an electromagnetic tool, or a nuclear magnetic resonance tool.

* * * * *